US005767615A

United States Patent [19]

Endo

[11] Patent Number: 5,767,615

[45] Date of Patent: Jun. 16, 1998

[54] ELECTRON GUN FOR A CATHODE RAY TUBE

[75] Inventor: Nobuyuki Endo, Fukusima, Japan

[73] Assignee: Sony Corporation, Tokyo, Japan

[21] Appl. No.: 835,830

[22] Filed: Apr. 16, 1997

Related U.S. Application Data

[63] Continuation of Ser. No. 607,556, Feb. 27, 1996, abandoned, which is a continuation of Ser. No. 275,346, Jul. 15, 1994, abandoned.

[30] Foreign Application Priority Data

Jul. 19, 1993 [JP] Japan ..... 5-178013

[51] Int. Cl.[6] ..... H01J 29/48

[52] U.S. Cl. ..... 313/447; 313/446; 313/451; 313/456; 313/270; 443/29; 443/34

[58] Field of Search ..... 313/441, 444, 313/446, 447, 451, 409, 417, 456, 270; 445/29, 34

[56] References Cited

U.S. PATENT DOCUMENTS 3,354,340 11/1967 Almer et al. ..... 313/447

3,716,739 2/1973 Say .

OTHER PUBLICATIONS

Patent Abstracts of Japan, Miyamoto Satoru et al. "Structure Body of Electron Gun for Camera Tube of Electrostatic Focusing Type," vol. 9, No. 39(E297) 19 Feb.1985, JP-A-59 180 937 Hitachi Seisakusho KK. Oct. 15, 1984.

*Primary Examiner*—Nimeshkumar Patel
*Attorney, Agent, or Firm*—Hill & Simpson

[57] ABSTRACT

A deformation produced by heat when a G1 grid is welded can be suppressed. A U-shaped slit (34) is formed on an outer peripheral wall (31) of a G1 grid (12). A spot-welding portion (X) is set to an end edge of a joint portion of the U-shaped slit (34) and this spot-welding portion (X) is spot-welded to a retainer (22) of a cathode (21) by a laser beam. In the G1 grid (12), the deformation produced by heat upon welding is absorbed by the surrounding portions of the slit (34). Therefore, it becomes possible to prevent the opposing surface opposing a G2 grid (13) from being expanded by heat. Thus, the spacing between the electrodes can be maintained to be a proper one and the angles of the electron beam emitting apertures can be maintained at proper ones. Therefore, it becomes possible to prevent the characteristic of the electron gun and the resolution of the cathode ray tube from being deteriorated.

10 Claims, 6 Drawing Sheets

ELECTRON GUN FOR A CATHODE RAY TUBE

This is a continuation of application Ser. No. 08/607,566, filed Feb. 27, 1996, now abandoned which is a continuation of Ser. No. 08/275,346 filed Jul. 15, 1994, now abandoned.

BACKGROUND OF THE INVENTION

1. Field of the Invention

The present invention relates to an electron gun for use with a cathode ray tube.

2. Description of the Prior Art

Heretofore, in a cathode ray tube (CRT), three electron beams E are emitted from a unipotential electron gun 10, shown in FIG. 1, for example, to impinge on a three-primary color phosphor screen formed on the surface of the cathode ray tube to display a predetermined color. FIG. 1 of the accompanying drawings shows an example of such conventional unipotential electron gun 10. Because the three-primary color phosphor screen is divided to provide very small phosphor screen parts, if the electron beams E are not impinged upon the phosphor screen at the precise positions, a mis-registration occurs so that the color is not displayed correctly. Therefore, the three electron beams E should be accurately emitted from predetermined positions of the electron gun 10.

As shown in FIG. 1, the electron gun 10 comprises a support pin 11, a G1 grid (first grid) 12 through G5 grid (fifth grid) 17 and a convergence plate (deflection plate) 18. The respective assembly parts 11 through 18 are spaced apart with proper spacings. Long glass beadings 20 are secured to pins 19 projected from respective side walls, whereby the respective assembly parts 11 through 18 are properly positioned and then fixed with predetermined spacings.

In order to accurately emit the electron beams E from the predetermined positions of the electron gun 10, the respective grids 12 to 17 should be assembled with a highly accurate relative positional relationship.

The G1 grid 12 houses therein a cathode 21 as shown in FIG. 2. The cathode 21 has a retainer fitted into a very small clearance produced between it and an outer peripheral wall 31 of the G1 grid 12. The outer peripheral wall 31 of the G1 grid 12 is spot-welded at its four spot-welding points X to the retainer 22 by some suitable welding means, such as laser beam or the like, as shown in FIGS. 3A, 3B.

A ceramic disk 23 (see FIG. 2) is fitted and secured into the retainer 22. The ceramic disk 23 includes thereon three cathode sleeves 24 for emitting the electron beams E and three guide pins 25 for supporting the cathode sleeves 24. Each of the cathode sleeves 24 is fixed to the guide pin 25 by means of a V-tab having a V-letter wire (not shown).

In the conventional electron gun 10, the outer peripheral portion 31 of the G1 grid 12 is spot-welded to the retainer 22 by a laser beam and the surrounding portion of the spot-welding portion is heated by a large quantity of heat generated upon spot-welding so that an opposing surface 32 that opposes the G2 grid 13 is expanded by about 20 to 30 μm, for example, as shown in FIG. 4. An expanded amount δ obtained at that time is fluctuated with an intensity of a laser output power used when the outer peripheral wall 31 of the G1 grid 12 is spot-welded to the retainer 22. Specifically, the expanded amount δ is increased as the intensity of the laser output power is increased.

When the G1 grid 12 is expanded at its opposing surface 32 opposing the G2 grid 13, the spacing between the G1 grid 12 and the G2 grid 13 is changed so that a cut-off voltage of the electron beam E fluctuates. There is then the disadvantage that the characteristic of the electron gun 10 is deteriorated.

Further, although the three electron beams E are emitted from the electron gun 10, an angle of the surface in which side beam apertures 33 to emit two side electron beams E are provided is changed so that the path of the electron beam E is displaced. There is then the disadvantage that the resolution of the cathode ray tube deteriorates.

OBJECTS AND SUMMARY OF THE INVENTION

It is, therefore, an object of the present invention to provide an electron gun for a cathode ray tube in which the characteristics of the electron gun are prevented from deteriorating.

It is another object of the present invention to provide an electron gun for a cathode ray tube in which the resolution of the cathode ray tube is prevented from deteriorating.

According to an aspect of the present invention, there is provided an electron gun for a cathode ray tube in which the cathode is fitted into the inside of a grid and an outer peripheral wall of the grid is welded to a retainer of the cathode. The electron gun is comprised of cutouts formed on the outer peripheral wall of the grid for absorbing deformation produced by heat, wherein end edge portions of the cutouts or portions surrounding the cutouts are welded to the retainer.

DETAILED DESCRIPTION OF THE PREFERRED EMBODIMENTS

An electron gun according to embodiments of the present invention will hereinafter be described with reference to the accompanying drawings, in which elements and parts identical to those of FIGS. 1 to 4 are marked with the same references and therefore need not be described in detail.

Figure 1:
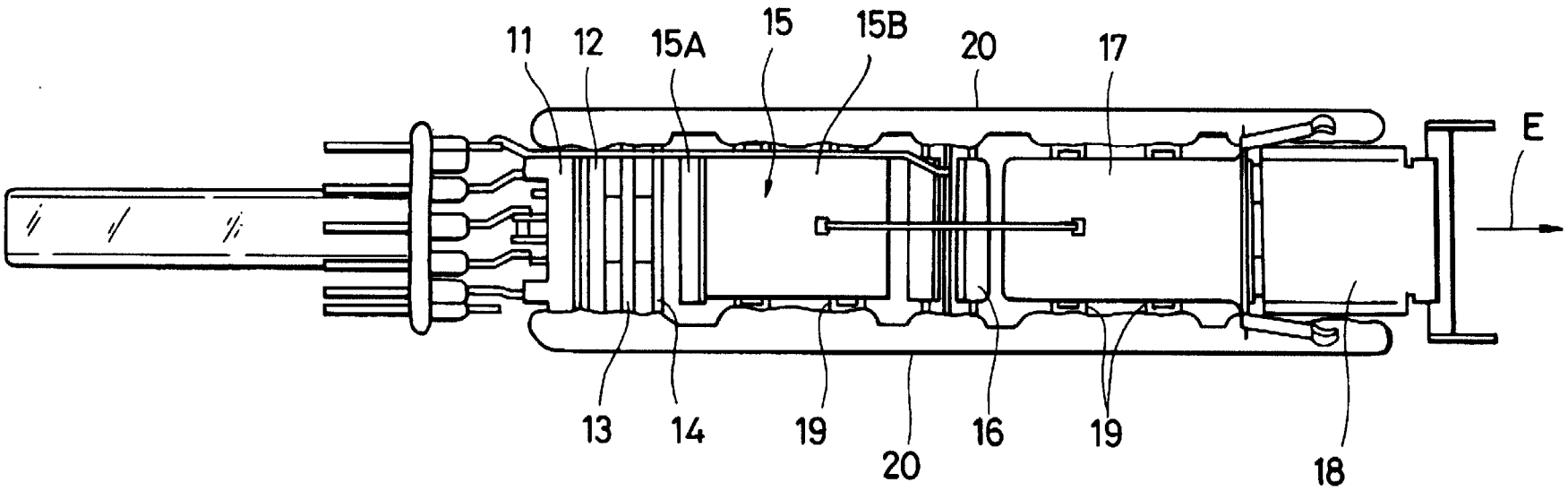
FIG. 1 (PRIOR ART)
FIG. 1 is a diagram showing an arrangement of a conventional unipotential electron gun.
Figure 2:
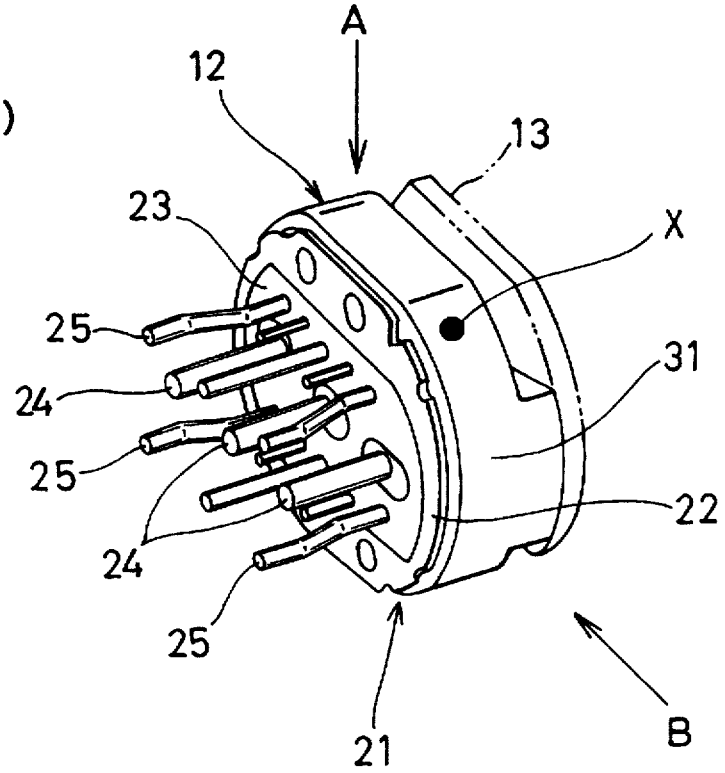
FIG. 2 (PRIOR ART)
FIG. 2 is a perspective view showing an arrangement of a G1 grid of the conventional electron gun shown in FIG. 1.
Figure 3A:
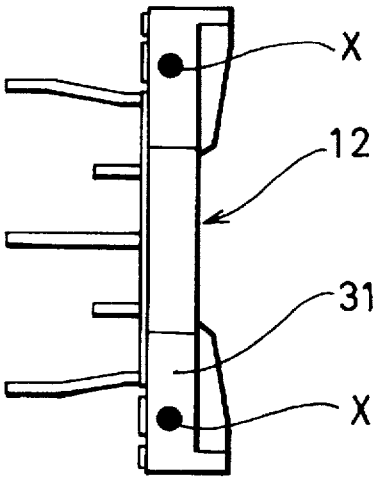
FIG. 3A (PRIOR ART)
FIG. 3A is a side view of the G1 grid seen from an arrow A direction of FIG. 2, and to which reference will be made in explaining the welding positions of the G1 grid.
Figure 3B:
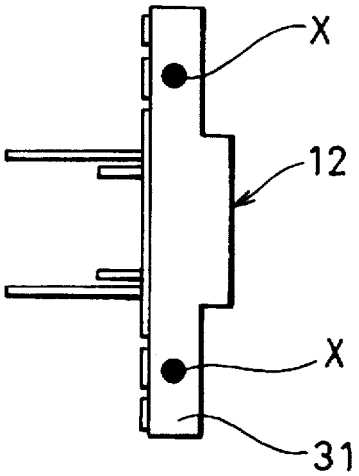
FIG. 3B (PRIOR ART)
FIG. 3B is a side view of the G1 grid seen from an arrow B direction of FIG. 2, and to which reference will be made in explaining the welding positions of the G1 grid.
Figure 4:
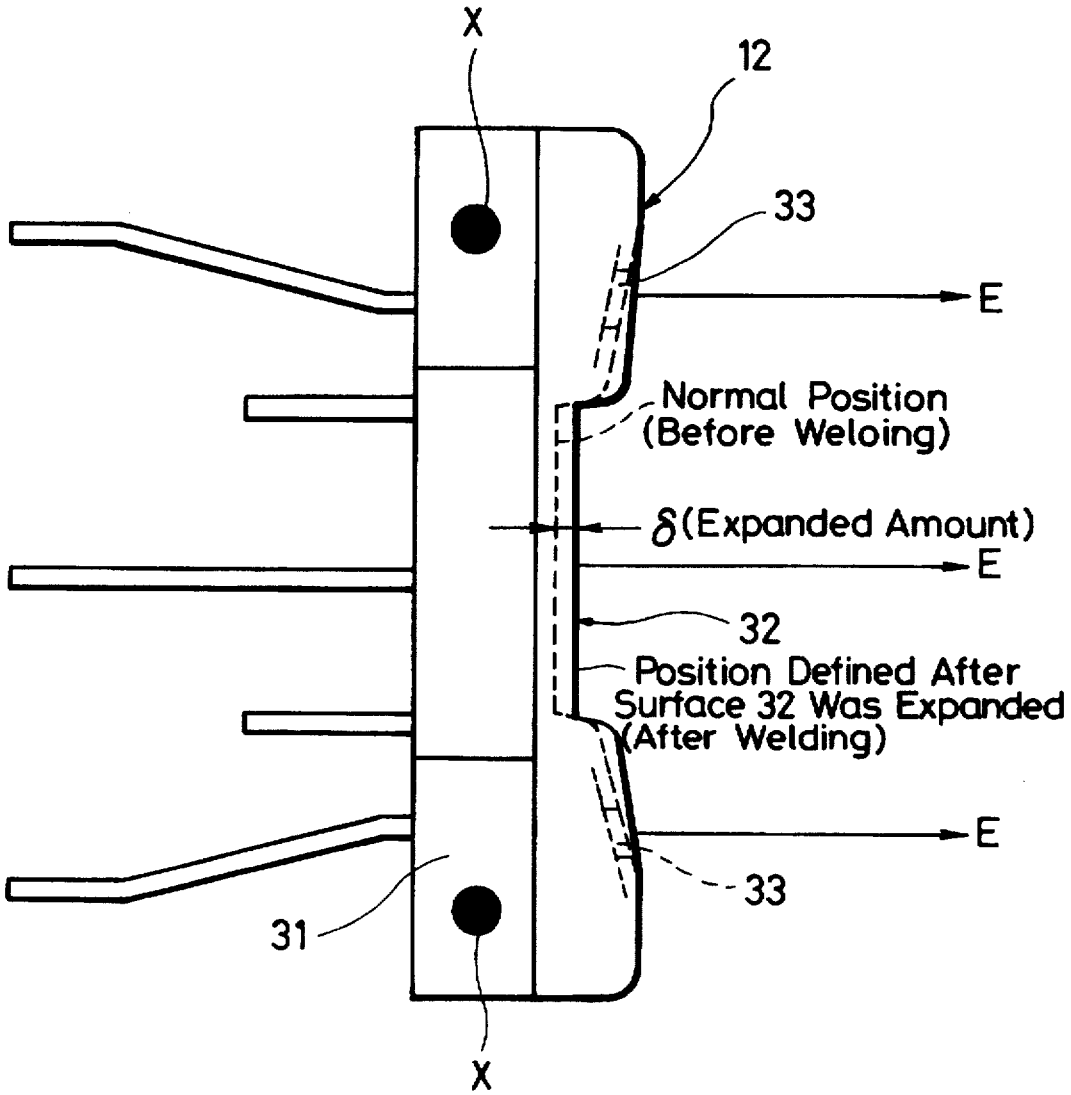
FIG. 4 (PRIOR ART)
FIG. 4 is a diagram used to explain the deformation produced in the G1 grid of the conventional electron gun by heat.
Figure 5:
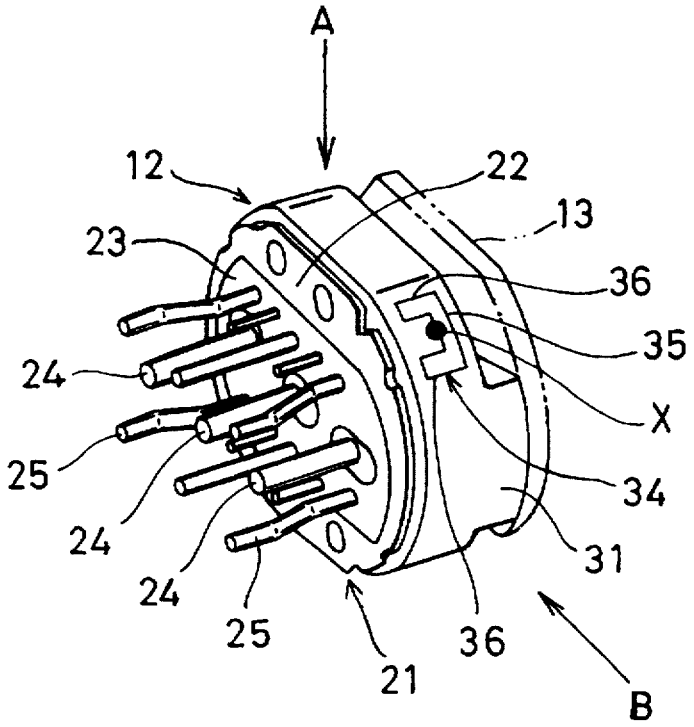
FIG. 5 is a perspective view showing an arrangement of the G1 grid of the electron gun according to an embodiment of the present invention.
Figure 6A:
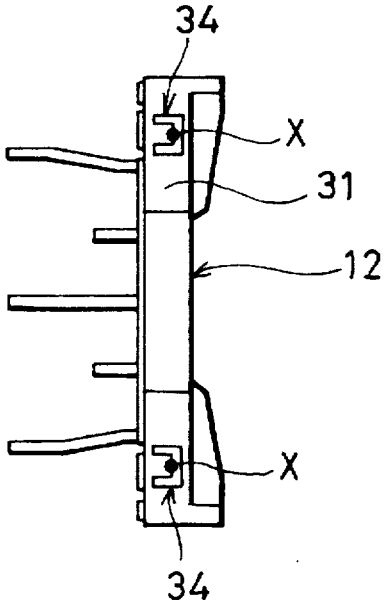
FIG. 6A is a side view of the G1 grid seen from an arrow A direction of FIG. 5, and to which reference will be made in explaining the welding positions of the G1 grid.
Figure 6B:
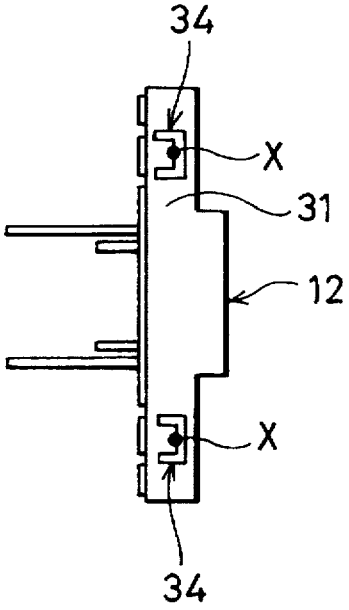
FIG. 6B is a side view of the G1 grid seen from the arrow B direction of FIG. 5, and to which reference will be made in explaining the welding positions of the G1 grid.

FIG. 5 shows an arrangement of the G1 grid (first grid) 12 of the electron gun according to the present invention. The G1 grid 12 can be applied to the electron gun 10 shown in FIG. 1. As shown in FIG. 5, the G1 grid 12 includes U-shaped slits 34 defined in the outer peripheral wall 31. The U-shaped slit 34 is disposed at its slit joint portion 35 on the opposing surface 32 opposing the G2 grid 13 and four U-shaped slits 34 are disposed at four proper positions on the outer peripheral wall 31 of the G1 grid 12 as shown in FIGS. 6A, 6B.

Figure 7:
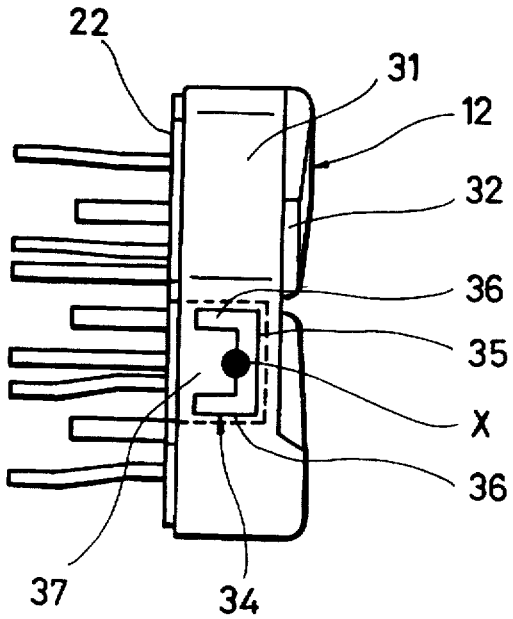
FIG. 7 is a diagram used to explain a spot-welding portion according to the present invention more in detail.

As shown in FIG. 7, a spot-welding portion X is set to an end edge of a projected portion 37 surrounded by two side edge portions 36 of the U-shaped slit 34 and the slit joint portion 35. This spot-welding portion X is spot-welded to the retainer 22 of the cathode 21 fitted into the G1 grid 12 by some suitable means, such as a laser beam or the like.

In the G1 grid 12, even though the spot-welding portion X and the surrounding portion of the spot-welding portion X are heated by a laser beam upon spot-welding, a deformation produced by heat is absorbed on the portion surrounding the U-shaped slit 34 and the portions spaced apart from the U-shaped slit 34 are prevented from being deformed by heat. Unlike the example of the conventional electron gun shown in FIG. 4, it is possible to prevent the opposing surface 32 opposing the G2 grid 32 from being expanded.

Figure 8:
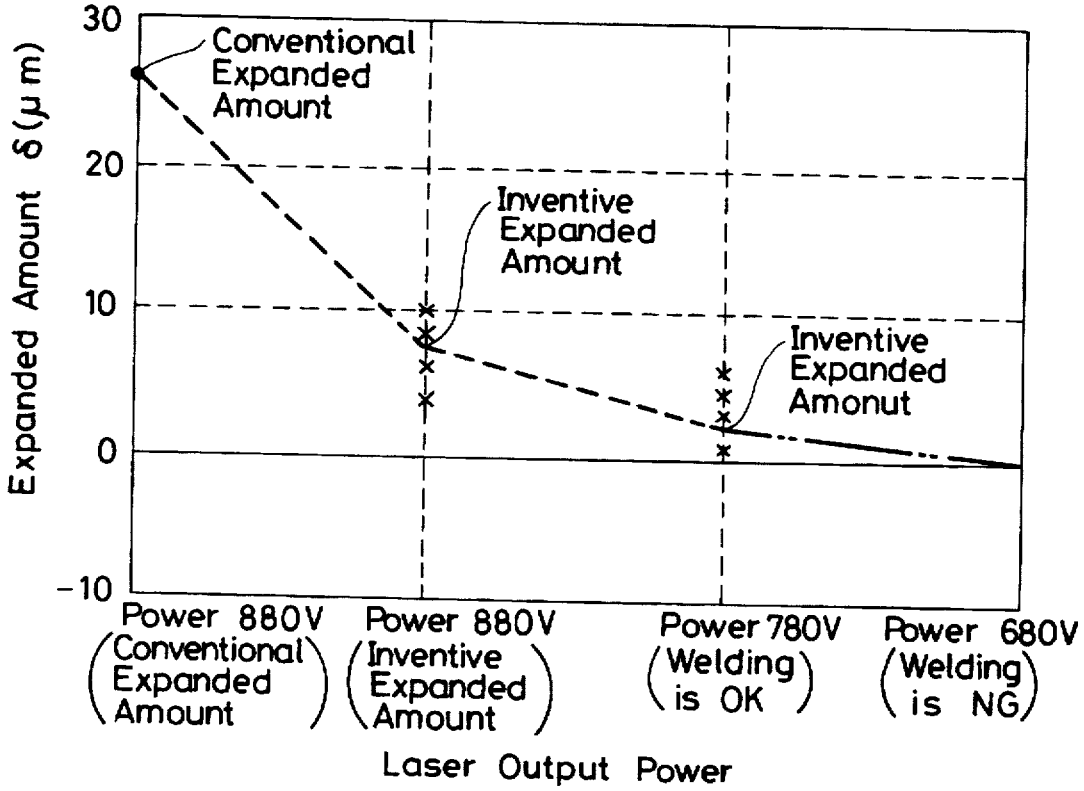
FIG. 8 is a graph used to explain a relationship between an intensity of a laser output power used upon welding and an expanded amount.

FIG. 8 is a graph used to explain a relationship between an intensity of a welding laser output power in the G1 grid 12 and the expanded amount δ (FIG. 4) of the opposing surface 32 opposing the G2 grid 13. FIG. 8 shows measured experimental results of the laser output powers and the expanded amount δ. Study of FIG. 8 reveals that, while the expanded amount δ in the conventional G1 grid 12 was about 26 μm when the intensity of the laser output power was 880V, the expanded amount δ in the G1 grid 12 of the inventive electron gun was considerably decreased to about 7 μm when the intensity of the laser output power was similarly 880V. If the intensity of the laser output power is decreased, then the expanded amount δ also is decreased more. However, if the intensity of the laser output power were too low, the welding could not be made with a laser output power of 680V according to this embodiment.

Figure 9A:
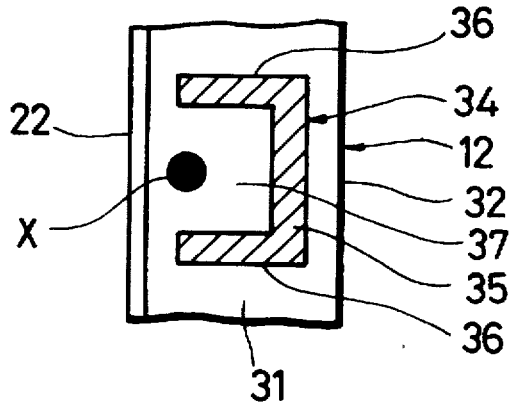
FIGS. 9A to 9C are diagrams used to explain other embodiments of the G1 grid according to the present invention, respectively.
Figure 9B:
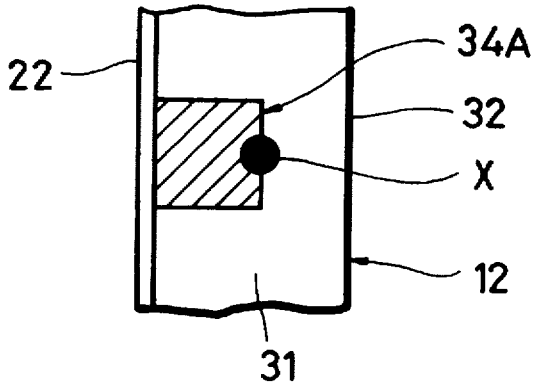
Figure 9C:
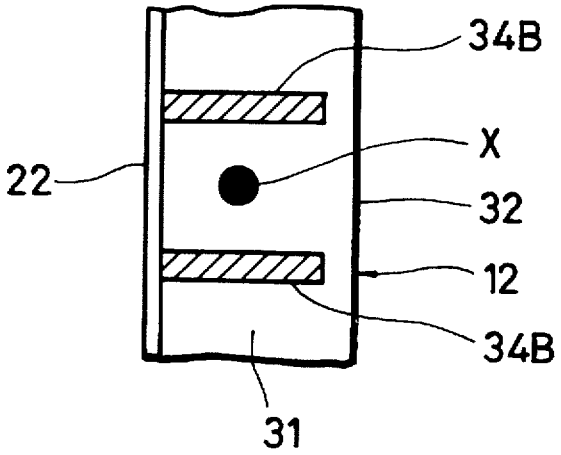

While the spot-welding portion X is set to the end edge of the projected portion 37 surrounded by the joint portion 35 and the two side edge portions 36 of the U-shaped slit 34 as described above, the present invention is not limited thereto and the following variants are also possible. Specifically, as shown in FIG. 9A, the spot-welding portion X may be set to a central portion of the projected portion 37. Further, as shown in FIG. 9B, a slit 34A may be formed on the outer peripheral wall 31 of the G1 grid 12 and the spot-welding portion X may be set to the end edge portion of the bottom portion of the slit 34A. Furthermore, as shown in FIG. 9C, two slits 34B, 34B are parallelly formed on the outer peripheral wall 31 and the spot-welding portion X may be set to a central portion of the two slits 34B, 34B.

Since the G1 grid 12 and the retainer 22 of the cathode 21 are welded to each other as described above, the deformation produced by heat is absorbed by the surrounding portions of the slits 34, 34A, 34B and therefore the opposing surface 32 opposing the G2 grid 13 are prevented from expanding.

As set forth, according to the present invention, the first grid includes the slit defined in the outer peripheral wall thereof and the end edge portion of the central portion of the slit is welded to the retainer of the cathode. Therefore, according to the present invention, the deformation produced by heat generated upon welding is absorbed by the surrounding portions of the slit and the portions spaced apart from the slit are not deformed by heat so that the spacing between the G1 grid and the G2 grid can be maintained with the proper dimensions. Thus, it becomes possible to prevent the characteristic of the electron gun from being deteriorated. Furthermore, since the emitting apertures of the electron beams are held at the predetermined angle, it becomes possible to prevent the resolution of the cathode ray tube from being deteriorated.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. An electron gun for a cathode ray tube comprising:

a grid having an outer peripheral wall and a planar cathode retainer having an edge around its circumference adjacent to an inner surface of the grid; and at least one cutout formed in said outer peripheral wall of said grid welded to the edge of the planar cathode retainer.

2. The electron gun of claim 1, wherein the grid is a first grid.

3. The electron gun of claim 1, wherein the at least one cutout is U-shaped having two side edge portions and a slit joint portion and wherein a location of welding is between the two side edge portions.

4. The electron gun of claim 1, wherein the at least one cutout defines two parallel slits; and wherein a welding location is substantially centrally located between the two parallel slits.

5. The electron gun of claim 1, wherein the at least one cutout is U-shaped having two side edge portions and a slit joint portion, and wherein a welding location is at an end edge of the slit joint portion at a bottom of the U-shaped cutout.

6. An electron gun for a cathode ray tube comprising:

a grid having an outer peripheral wall and a substantially planar cathode retainer having an edge around its circumference adjacent to an inner surface of the grid;

at least one cutout formed in said outer peripheral wall of said grid welded to the edge of the planar cathode retainer, and wherein the outer peripheral wall of the grid surrounds the substantially planar cathode retainer.

7. The electron gun of claim 6, wherein the grid is a first grid.

8. The electron gun of claim 6, wherein the at least one cutout is U-shaped.

9. The electron gun of claim 6, wherein the at least one cutout defines two parallel slits; and wherein a welding location is substantially centrally located between the two parallel slits.

10. The electron gun of claim 6, wherein the at least one cutout is U-shaped having two side edge portions and a slit joint portion, and wherein a welding location is at an end edge of the slit joint portion at a bottom of the U-shaped cutout.

* * * * *